US009380391B2

(12) United States Patent
Yoo et al.

(10) Patent No.: US 9,380,391 B2
(45) Date of Patent: Jun. 28, 2016

(54) MICROPHONE AND METHOD OF MANUFACTURING THE SAME

(71) Applicant: Hyundai Motor Company, Seoul (KR)

(72) Inventors: Ilseon Yoo, Seoul (KR); Hyunsoo Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/555,873

(22) Filed: Nov. 28, 2014

(65) Prior Publication Data

US 2016/0088401 A1 Mar. 24, 2016

(30) Foreign Application Priority Data

Sep. 23, 2014 (KR) ..... 10-2014-0126786

(51) Int. Cl.
*H04R 17/02* (2006.01)
*H04R 31/00* (2006.01)

(52) U.S. Cl.
CPC ..... *H04R 17/02* (2013.01); *H04R 31/00* (2013.01)

(58) Field of Classification Search
CPC ..... H04R 2440/00–2440/07; H04R 17/02; H04R 2217/00–2217/03; H04R 7/04
USPC ..... 381/152, 173, 190, 431
See application file for complete search history.

(56) References Cited

U.S. PATENT DOCUMENTS 3,700,938 A * 10/1972 Bryant ..... H04R 7/22 381/173
5,490,220 A * 2/1996 Loeppert ..... B81B 3/0072 381/173
7,536,769 B2 * 5/2009 Pedersen ..... B81B 3/0072 381/173
8,059,842 B2 * 11/2011 Suzuki ..... H04R 19/04 381/173

FOREIGN PATENT DOCUMENTS

JP 2007-013509 A 1/2007
JP 2007-243757 A 9/2007
JP 2010-232971 A 10/2010
JP 2013-115595 A 6/2013
KR 10-2009-0041041 4/2009
KR 10-2011-0025697 3/2011
KR 10-1156635 6/2012

* cited by examiner

*Primary Examiner* — Suhan Ni
(74) *Attorney, Agent, or Firm* — Mintz Levin Cohn Ferris Glovsky and Popeo, P.C.; Peter F. Corless

(57) ABSTRACT

A microphone and method of manufacturing the microphone are provided. The microphone includes a substrate that has a penetration aperture, a vibration film disposed on the substrate that covers the penetration aperture, and a first electrode disposed on the vibration film. The first electrode includes a first portion and a second portion separated from each other. In addition, the microphone includes a piezoelectric layer disposed on the second portion of the first electrode, a second electrode disposed on the piezoelectric layer, and a fixed electrode. Further, the first portion of the first electrodes is disposed at a substantially center portion of the vibration film and the second portion of the first electrode is disposed at an edge portion of the vibration film.

7 Claims, 7 Drawing Sheets

MICROPHONE AND METHOD OF MANUFACTURING THE SAME

CROSS-REFERENCE TO RELATED APPLICATION

This application claims priority to and the benefit of Korean Patent Application No. 10-2014-0126786 filed on Sep. 23, 2014, the entire contents of which are incorporated herein by reference.

BACKGROUND

1. Field of the Invention

The present invention relates to a microphone and a manufacturing method thereof.

2. Description of the Related Art

Microphones, which convert a sound wave into an electrical signal, are currently are being manufactured in a decreased size using Micro Electro Mechanical System (MEMS) technology. The MEMS microphone is more resistant to humidity and heat than an Electret Condenser Microphone (ECM), which allows integration with a signal processing circuit.

In general, the MEMS microphone is divided into a capacitive type and a piezoelectric type. The capacitive type of MEMS microphone includes a fixed electrode and a vibration film, so when sound pressure is applied to the vibration film from the exterior, a capacitance value is changed while an interval between the fixed electrode and the vibration film is also changed. The sound pressure is measured using a generated electrical signal. The piezoelectric type of MEMS microphone includes a vibration film. In addition, when the vibration film is changed by sound pressure from the exterior, an electrical signal is generated by a piezoelectric effect, to measure the sound pressure.

The above information disclosed in this section is merely for enhancement of understanding of the background of the invention, and therefore it may contain information that does not form the prior art that is already known in this country to a person of ordinary skill in the art.

SUMMARY

The present invention provides a microphone and a method for manufacturing the same that may improve sensitivity of the microphone. According to an exemplary embodiment of the present invention a microphone may include: a substrate, which may include a penetration aperture; a vibration film disposed on the substrate that covers the penetration aperture; a first electrode disposed on the vibration film that includes a first portion and a second portion separated from each other; a piezoelectric layer disposed on the second portion of the first electrode and made of a piezoelectric material; a second electrode disposed on the piezoelectric layer; and a fixed electrode separated from the first electrode and the second electrode, disposed top of the first electrode and the second electrode, and including a plurality of air inlets, wherein the first portion of the first electrode is disposed at a substantially center portion of the vibration film, and the second portion of the first electrode is disposed at an edge portion of the vibration film.

The piezoelectric layer may contact (e.g., abutting) the second portion of the first electrode and the second electrode. The second portion of the first electrode may enclose the first portion of the first electrode. The substrate may be silicon and the vibration film may be polysilicon or a silicon nitride. The microphone according to an exemplary embodiment of the present invention may further include a supporting layer disposed on the vibration film and the first electrode and configured to support the fixed electrode.

A manufacturing method of a microphone according to an exemplary embodiment of the present invention may include: forming a vibration film on a substrate; forming a first electrode that includes a first portion and a second portion separated from each other on the vibration film; forming a piezoelectric layer on the second portion of the first electrode; forming a second electrode on the piezoelectric layer; and forming a fixed electrode separated from the first electrode and the second electrode, disposed at a top of the first electrode and the second electrode, and including a plurality of air inlets, wherein the first portion of the first electrode may be disposed at a substantially center portion of the vibration film, and the second portion of the first electrode may be disposed at an edge portion of the vibration film.

The formation of the fixed electrode may include: forming a sacrificial layer on the first electrode and the second electrode; depositing and patterning a metal layer on the sacrificial layer; and removing a portion of the sacrificial layer. The manufacturing method of the microphone according to an exemplary embodiment of the present invention may further include etching a rear surface of the substrate to form a penetration aperture that exposes the vibration film.

As described above, according to an exemplary embodiment of the present invention, by disposing the piezoelectric layer at the edge of the vibration film, the sound may also be sensed using the piezoelectric layer at the edge of the vibration film having a minimal vibration width, which may improve the sensitivity of the microphone.

BRIEF DESCRIPTION OF THE DRAWINGS

The above and other features of the present invention will now be described in detail with reference to certain exemplary embodiments thereof illustrated in the accompanying drawings which are given herein below by way of illustration only, and thus are not limitative of the present invention, and wherein.

DETAILED DESCRIPTION OF THE EMBODIMENTS

Figure 1:
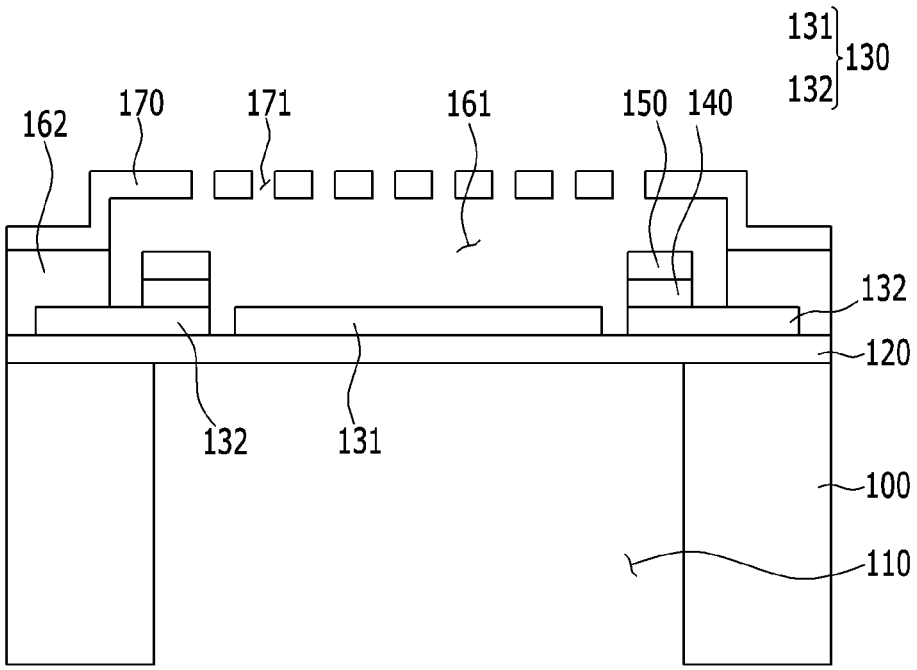
FIG. 1 is an exemplary cross-sectional view of a microphone according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, exemplary embodiments of the present invention will be described in detail with reference to the accompanying drawings. As those skilled in the art would realize, the described exemplary embodiments may be modified in various different ways, all without departing from the spirit or scope of the present invention. On the contrary, exemplary embodiments introduced herein are provided to make disclosed contents thorough and complete and to sufficiently transfer the spirit of the present invention to those skilled in the art. In the drawings, the thickness of layers, films, panels, regions, etc., are exaggerated for clarity. Further, it will be understood that when a layer is referred to as being "on" another layer or substrate, it can be directly on the other layer or substrate, or intervening them may also be present.

Figure 2:
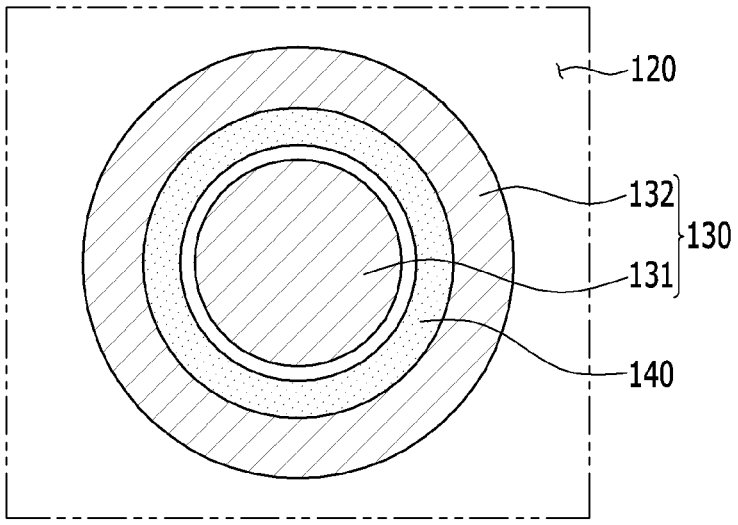
FIG. 2 is an exemplary top plan view of a vibration film, a first electrode, and a piezoelectric layer according to an exemplary embodiment of the present invention.
Figure 3:
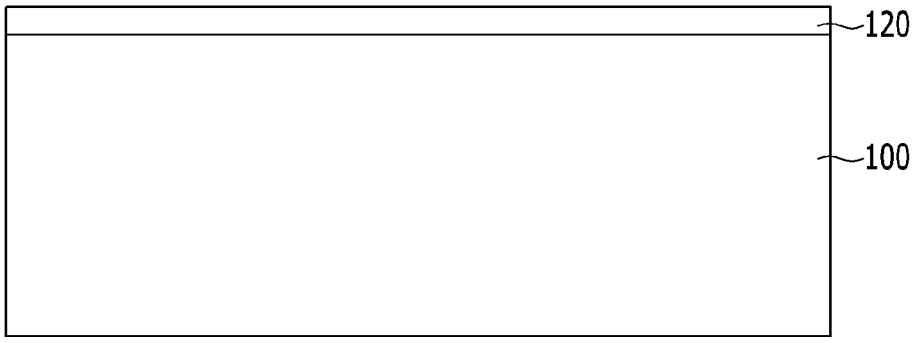
FIG. 3 to FIG. 7 are exemplary views showing a manufacturing method of a microphone according to an exemplary embodiment of the present invention.

A microphone according to an exemplary embodiment of the present invention will be described with reference to FIG. 1 and FIG. 2. FIG. 1 is an exemplary cross-sectional view of a microphone according to an exemplary embodiment of the present invention. FIG. 2 is an exemplary top plan view of a vibration film, a first electrode, and a piezoelectric layer according to an exemplary embodiment of the present invention. Referring to FIG. 1 and FIG. 2, the microphone according to the present exemplary embodiment may include a substrate 100, a vibration film 120, a first electrode 130, and a fixed electrode 170.

The substrate 100 may be made of silicon and may be formed with a penetration aperture 110. The vibration film 120 may be disposed on the substrate 100 and may cover the penetration aperture 110. The vibration film 120 may be a single layer structure made of polysilicon or a silicon nitride (SiNx). Also, the vibration film is not limited thereto, but the vibration film 120 may be a multilayer structure in which a polysilicon layer and a silicon nitride layer are alternately deposited. A portion of the vibration film 120 may be exposed by the penetration aperture 110 formed in the substrate 100, and the exposed portion may be configured to vibrate based on a sound transmitted from the exterior.

The first electrode 130 may be disposed on the vibration film 120. Further, the first electrode 130 may include a first portion 131 and a second portion 132 separated from the first portion 131 and configured to enclose the first portion 131. In other words, the first portion 131 of the first electrode 130 may be disposed at a substantially center portion of the vibration film 120, and the second portion 132 of the first electrode 130 may be disposed at the edge portion of the vibration film 120.

The fixed electrode 170 may be disposed on the first electrode 130. In particular, the fixed electrode 170 may be fixed on a supporting layer 162. The supporting layer 162 may be disposed on the vibration film 120 and the second portion 132 of the first electrode 130, and may be configured to support the fixed electrode 170. An air layer 161 may be formed between the fixed electrode 170 and the first electrode 130, to separate the fixed electrode 170 and the first electrode 130 by a predetermined distance. In addition, the fixed electrode 170 may include a plurality of air inlets 171.

The sound from the exterior may flow in via the air inlet 171 and stimulate the vibration film 120 to cause the vibration film 120 to vibrate. Accordingly, the first electrode 130 disposed on the vibration film 120 may also be configured to vibrate along with the vibration film 120. In particular, the distance between the first electrode 130 and the fixed electrode 170 may vary, and accordingly, the capacitance between the first electrode 130 and the fixed electrode 170 may also vary.

Alternatively, the vibration film 120 may be configured to vibrate at the penetration aperture 110 and the air layer 161 and a change degree of the vibration film 120 may gradually decrease from the substantially center portion moving towards the edge. In other words, the vibration width may be substantial at the substantially center portion of the vibration film 120, and the vibration width may decrease at the edge portion of the vibration film 120. Accordingly, since the interval change between the first portion 131 of the first electrode 130 and the fixed electrode 170 may increase, detecting a change of the capacitance there between may be easier. As described above, the changed capacitance may be changed into an electrical signal within a signal process circuit (not shown) via a pad (not shown) respectively connected to the first portion 131 of the first electrode 130, thereby detecting a sound from the exterior.

The microphone according to an exemplary embodiment of the present invention may further include a piezoelectric layer 140 and a second electrode 150 disposed between the first electrode 130 and the fixed electrode 170. The piezoelectric layer 140 may be disposed on the second portion 132 of the first electrode 130, and the second electrode 150 may be disposed on the piezoelectric layer 140. The piezoelectric layer 140 may contact (e.g., abutting) the second portion 132 of the first electrode 130 and the second electrode 150. The second electrode 150 and the fixed electrode 170 may disposed to be separated by the predetermined distance.

The piezoelectric layer 140 may be made of a piezoelectric material such as lead zirconate titanate (PZT), barium titanate ($BaTiO_3$), and Rochelle salt. When the sound pressure is applied by the sound, the piezoelectric layer 140 may be configured to generate a piezoelectric signal. The piezoelectric signal may be changed into the electrical signal within the signal process circuit (not shown) via the pad (not shown) respectively connected to the second portion 132 of the first electrode 130 and the second electrode 150, thereby sensing the sound from the outside.

The interval change between the second portion 132 of the first electrode 130 and the fixed electrode 170 may not be substantial thus the capacitance change may be difficult to detect. In other words, the edge portion of the vibration film 120 may have a substantially small width of the vibration thus it is an external sound may be difficult to detect. However, the piezoelectric layer 140 may be disposed on the edge of the vibration film 120, that is, the second portion 132 of the first electrode 130, and thereby the external sound may be detected using the piezoelectric layer 140 at the edge portion of the vibration film 120.

As described above, since the external sound may be detected by using the piezoelectric layer 140 at the edge portion of the vibration film 120, the sensitivity of the microphone may increase. In addition, at the edge portion of the vibration film 120, the external sound may be detected by detecting the capacitance change based on the interval change between the second electrode 150 and the fixed electrode 170.

A manufacturing method of a microphone according to an exemplary embodiment of the present invention will be described with reference to FIG. 3 to FIG. 7. FIG. 3 to FIG. 7 are exemplary views showing a manufacturing method of a microphone according to an exemplary embodiment of the present invention. Referring FIG. 3, after providing a substrate 100, a vibration film 120 may be formed on the substrate 100. In particular, the substrate 100 may be made of silicon and the vibration film 120 may be a single layer structure using polysilicon or a silicon nitride (SiNx). Further, the vibration film is not limited thereto, and the vibration film 120 may be a multilayer structure in which a polysilicon layer and a silicon nitride layer are alternately deposited.

Figure 4:
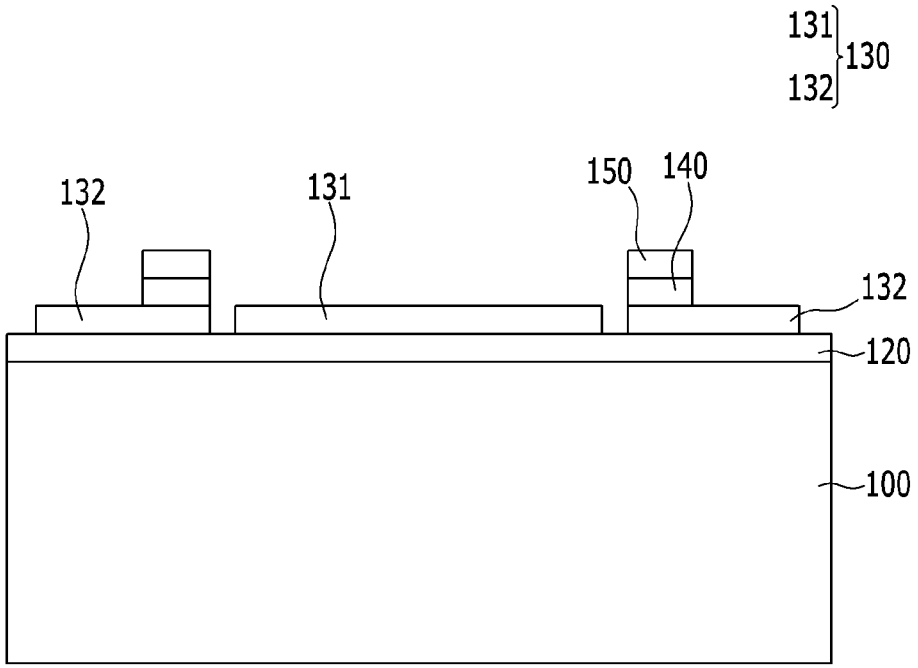

Referring to FIG. 4, after forming a first electrode 130 that includes a first portion 131 and a second portion 132 separated from each other on the vibration film 120, a piezoelectric layer 140 may be formed on the second portion 132 of the first electrode 130, and then a second electrode 150 may be formed on the piezoelectric layer 140. The second portion 132 of the first electrode 130 may be configured to enclose the first portion 131. In other words, the first portion 131 of the first electrode 130 may disposed at a substantially center portion of the vibration film 120 and the second portion 132 of the first electrode 130 may be disposed at an edge portion of the vibration film 120. The piezoelectric layer 140 may be made of a piezoelectric material such as lead zirconate titanate (PZT), barium titanate ($BaTiO_3$), and Rochelle salt. The piezoelectric layer 140 may contact the second portion 132 of the first electrode 130 and the second electrode 150.

Figure 5:
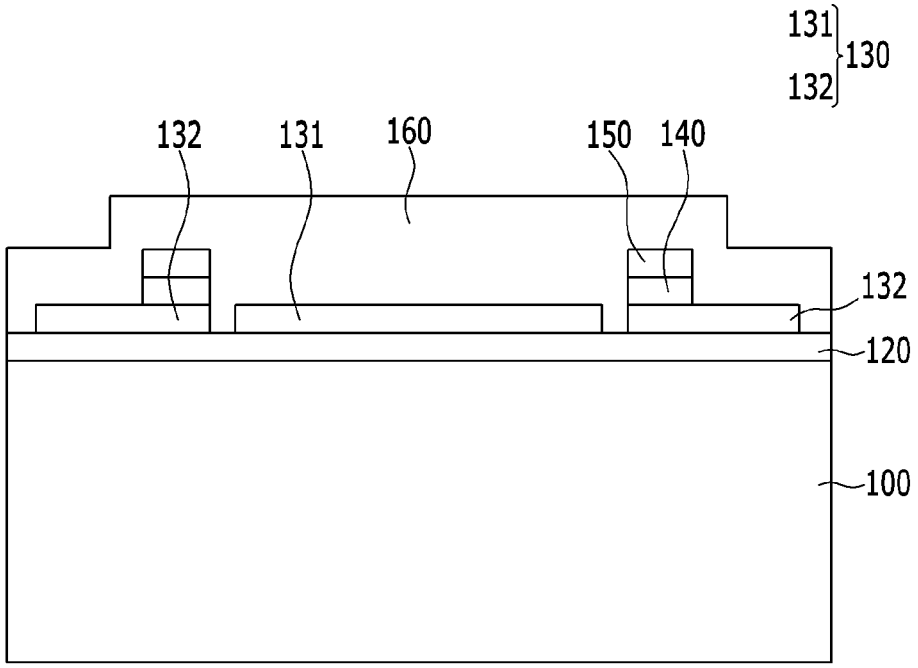

Referring to FIG. 5, a sacrificial layer 160 may be formed on the vibration film 120, the first electrode 130, and the second electrode 150. The sacrificial layer 160 may be formed of a photosensitive material. The photosensitive material may be formed through a process, have a stable thermal and mechanical structure, and be easily removed. By forming the sacrificial layer 160, a shape of the sacrificial layer 160 may be varied. Further, the sacrificial layer 160 is not limited thereto, and the sacrificial layer 160 may be formed of a silicon oxide or a silicon nitride.

Figure 6:
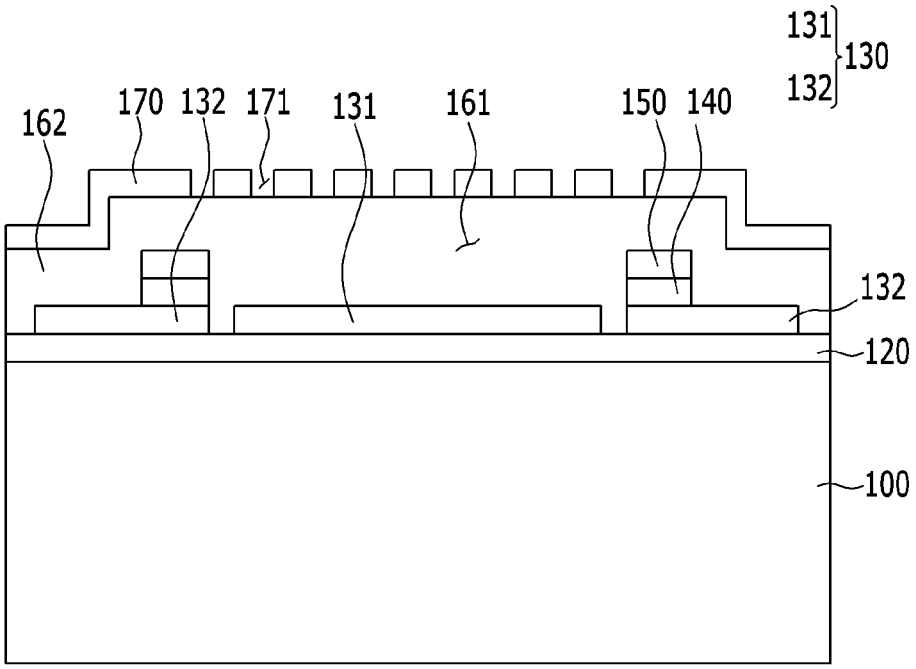

Referring to FIG. 6, a fixed electrode 170 that includes a plurality of air inlets 171 may be formed on the sacrificial layer 160. The fixed electrode 170 may be formed by patterning a metal layer after forming the metal layer on the sacrificial layer 160. In particular, the patterning of the metal layer may be performed by etching the metal layer using a photosensitive layer pattern as a mask after forming a photosensitive layer on the metal layer, and exposing and developing the photosensitive layer to form the pattern.

Figure 7:
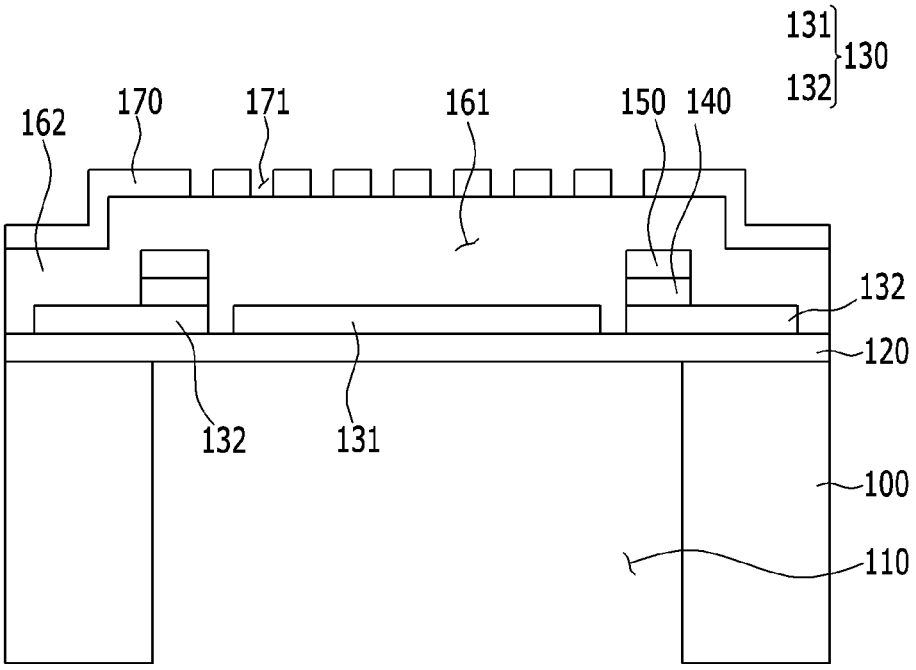

Referring to FIG. 7, a penetration aperture 110 may formed on the substrate 100. The penetration aperture 110 may be configured the vibration film 120. The penetration aperture 110 may be formed by performing dry etching or wet etching to a rear surface of the substrate 100. The etching of the rear surface of the substrate 100 may be performed until the vibration film 120 is exposed.

Referring to FIG. 1, a portion of the sacrificial layer 160 may be removed to form an air layer 161 and a supporting layer 162. The sacrificial layer 160 may be removed through the air inlet 171 by the wet etching using an etchant. Also, the sacrificial layer 160 may be removed by the dry etching such as $O_2$ plasma ashing through the air inlet 171. The air layer 161 between the first electrode 130 and the fixed electrode 170 may be formed by removing the portion of the sacrificial layer 160 using the wet etching or the dry etching, and the sacrificial layer 160 that is not removed may form the supporting layer 162 configured to support the fixed electrode 170.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

100: substrate
110; penetration aperture
120: vibration film
130: first electrode
131: first portion
132: second portion
140: piezoelectric layer
150: second electrode
160: sacrificial layer
161: air layer
162: supporting layer
170: fixed electrode
171: air inlet

What is claimed is:

1. A microphone, comprising:
a substrate that includes a penetration aperture;
a vibration film disposed on the substrate to cover the penetration aperture;
a first electrode disposed on the vibration film that includes:
a first portion; and
a second portion separated from the first portion;
a piezoelectric layer disposed on the second portion of the first electrode and made of a piezoelectric material;
a second electrode disposed on the piezoelectric layer; and
a fixed electrode separated from the first electrode and the second electrode, disposed top of the first electrode and the second electrode, and including a plurality of air inlets,
wherein the first portion of the first electrode is disposed at a substantially center portion of the vibration film, and the second portion of the first electrode is disposed at an edge portion of the vibration film.

2. The microphone of claim 1, wherein the piezoelectric layer contacts the second portion of the first electrode and the second electrode.

3. The microphone of claim 2, wherein the second portion of the first electrode encloses the first portion of the first electrode.

4. The microphone of claim 1, wherein the substrate is formed of silicon.

5. The microphone of claim 4, wherein the vibration film is formed of polysilicon or a silicon nitride.

6. The microphone of claim 1, further comprising:
a supporting layer disposed on the vibration film and the first electrode and configured to support the fixed electrode.

7. A vehicle comprising the microphone of claim 1.

* * * * *